US009607589B2

(12) United States Patent
Baker

(10) Patent No.: US 9,607,589 B2
(45) Date of Patent: Mar. 28, 2017

(54) STRING BENDER

(71) Applicant: Waylon Baker, Plant City, FL (US)

(72) Inventor: Waylon Baker, Plant City, FL (US)

( * ) Notice: Subject to any disclaimer, the term of this patent is extended or adjusted under 35 U.S.C. 154(b) by 385 days.

(21) Appl. No.: 13/741,358

(22) Filed: Jan. 14, 2013

(65) Prior Publication Data

US 2013/0180378 A1 Jul. 18, 2013

Related U.S. Application Data

(60) Provisional application No. 61/586,667, filed on Jan. 13, 2012.

(51) Int. Cl.
*G10D 3/14* (2006.01)

(52) U.S. Cl.
CPC ..... *G10D 3/146* (2013.01)

(58) Field of Classification Search
CPC G10D 1/00; G10D 1/005; G10D 3/00; G10D 3/18
USPC ..... 84/293, 290, 267
See application file for complete search history.

(56) References Cited

U.S. PATENT DOCUMENTS 4,944,208 A * 7/1990 Kusek ..... G10D 3/146 84/313

* cited by examiner

*Primary Examiner* — Kimberly Lockett
(74) *Attorney, Agent, or Firm* — Cygnet IP Law, P.A.; Stephen W. Aycock, II

(57) ABSTRACT

A string bender includes a base portion configured to anchor a plurality of strings and to be removably (or releasably) mounted to a guitar body without requiring drilling or cutting of the guitar body. The string bender can also include at least one bar extending from the base portion in a direction substantially toward a top of the guitar body, the at least one bar being attached to at least one corresponding cam and disposed so as to be able to rotate relative to the base portion such that a rotation of the at least one bar causes a rotation of the cam and a change in tension of a string associated with the cam. The string bender can be constructed to bend one or more strings, for example the B and/or G strings. The string bender can also be constructed to fit a variety of guitar styles, such as the Gibson Les Paul-style and the Fender Telecaster-style guitars.

19 Claims, 8 Drawing Sheets

STRING BENDER

RELATED APPLICATIONS

This application claims the benefit of U.S. Provisional Application No. 61/586,667, entitled "String Bender" and filed on Jan. 13, 2012, which is incorporated herein by reference in its entirety.

FIELD

Embodiments relate generally to a string bender for stringed musical instruments, and, more particularly, to a guitar string bender having at least one bar disposed at or near a location where the palm of the picking/strumming hand of a player would normally rest when playing the guitar.

BACKGROUND

Bending, or changing the tension of, a guitar string to change the pitch of a note being played can be a technique used in certain styles of music, such as country-western. Some conventional string benders for guitars may require movement of the guitar body relative to a strap in order to activate a string bending mechanism. Other conventional string benders may require that the strumming/picking hand (e.g., typically the right hand of a right-handed player) be moved from a normal playing position in order to activate the bending mechanism.

Still other conventional string benders may require modification of the guitar body (e.g., drilling and/or cutting) in order to be mounted on the guitar.

Embodiments were conceived in light of the above-mentioned problems and limitations, among other things.

DETAILED DESCRIPTION

In general, an embodiment can include a string bender for bending one or more strings of a stringed musical instrument, such as a guitar. The string bender can have one or more bars for activating the bending mechanism. The one or more bars can be disposed at or a location where the palm of the picking/strumming hand of a player would normally rest when playing the guitar.

For example, an embodiment can include a dual string bender for bending the "B" and "G" strings of a guitar having conventional string tuning (i.e, the second and third strings from the bottom). Another embodiment can include a single string bender for bending the "B" or "G" strings of a guitar having conventional string tuning. The dual or single string benders can be constructed to mount on a Gibson Les Paul-style guitar or a Fender Telecaster-style guitar.

It will be appreciated that an embodiment can be constructed to bend strings other than the "B" and "G" strings. Also, an embodiment can be constructed to mount on guitars other than the Gibson Les Paul-style or the Fender Telecaster-style guitars.

Figure 1:
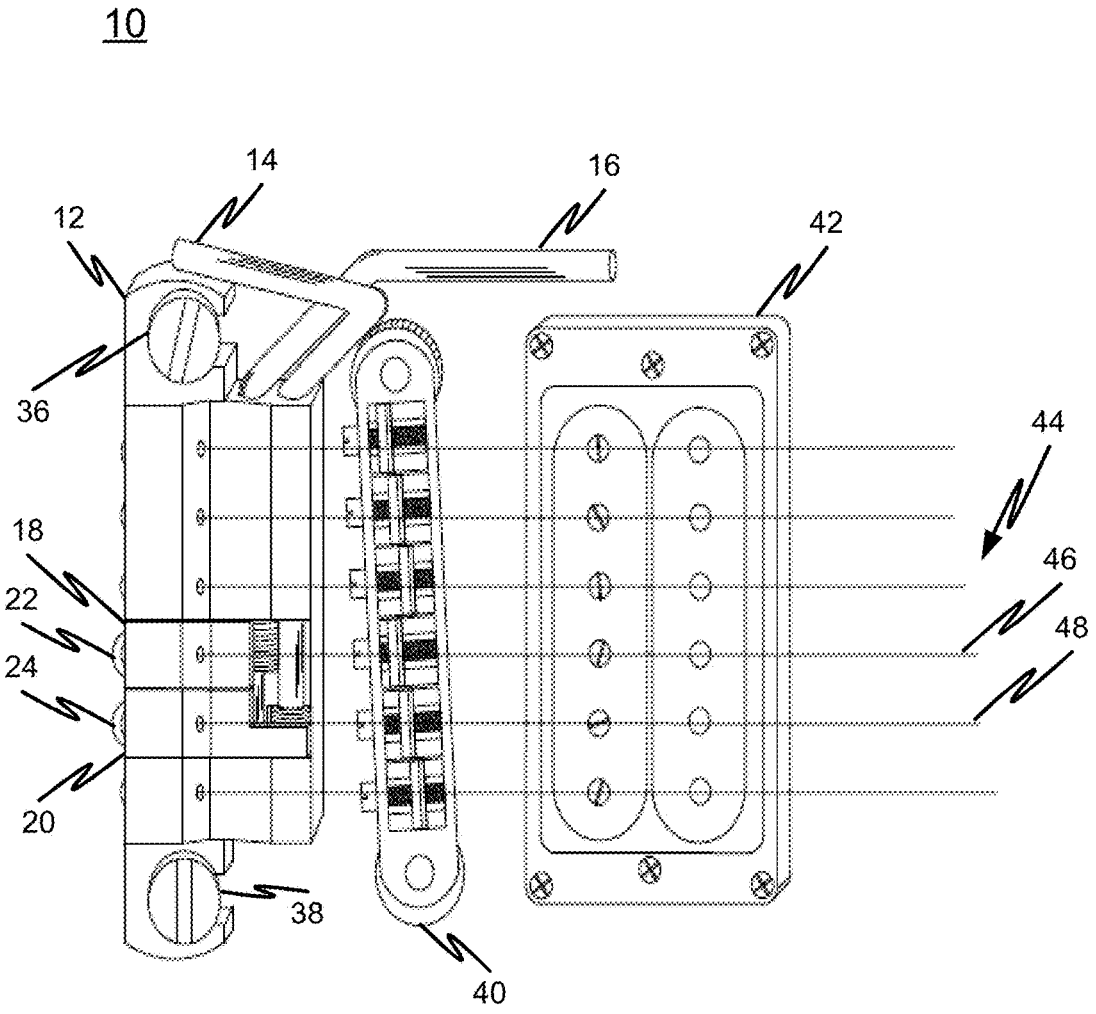
FIG. 1 is a perspective view of an exemplary string bender in accordance with at least one embodiment.

FIG. 1 is a perspective view of an exemplary string bender 10 for a guitar that includes a base portion 12, a first bar 14, a second bar 16, a second moveable portion 18, a first moveable portion 20, a second adjustment screw 22 and a first adjustment screw 24. The base portion 12 is constructed to removably (or releasably) mount to posts 38 used to mount the stop tailpiece of the guitar (e.g., a Gibson Les Paul-style guitar).

FIG. 1 also shows position of the string bender 10 relative to the bridge 40 and the pickup 42 of the guitar. The guitar has a plurality of strings 44 anchored by the string bender 10. The string bender 10 is adapted to bend the second string 48 and the third string 46 of the guitar.

In operation, a player can put pressure on one or both of the bars 14 and 16 to cause the bars to rotate and, in turn, to rotate a cam that moves a respective moveable portion (18 or 20) to a second or rotated position and causes tension in a corresponding string to change (e.g., to increase, thus raising the pitch of a note being played, or to be played). When pressure on the bar is released, the moveable portion returns to a first resting position and the string tension (and hence the pitch) return to approximately the same value as before the bar was pressed.

The location of the bars 14 and 16 toward the top of the guitar body and near the stop tailpiece and pickup permit a player to keep his/her strumming/picking hand in a normal playing position and still be able to bend a string. Further, because the string bending mechanism does not rely on movement of the guitar body relative to the strap, the guitar body can remain in a normal playing position and no strap tension change is required to bend a string.

It will be appreciated that an embodiment can include a single string bender mechanism, a dual string bender mechanism or a mechanism for bending more than two strings. Also, it will be appreciated that the bender is shown coupled to the B and G strings for bending, however an embodiment could be built to bend other strings.

Figure 2:
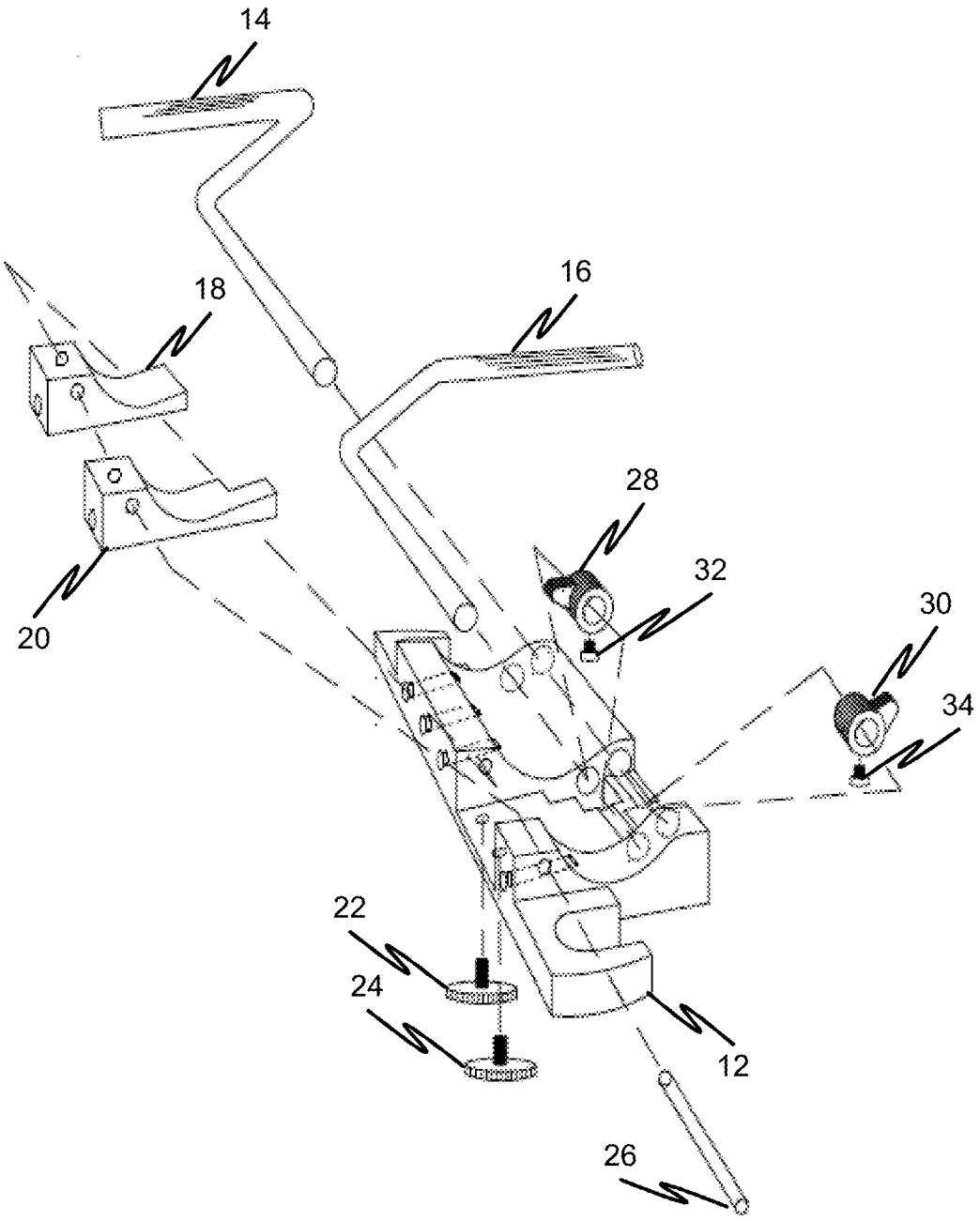
FIG. 2 is an exploded view of an exemplary string bender in accordance with at least one embodiment.

FIG. 2 is an exploded view of the string bender 10. In addition to the parts described above with respect to FIG. 1, FIG. 2 shows a pin 26 for mounting the moveable portions 18 and 20 to the base portion 12 so that the moveable portions 18 and 20 can rotate relative to the base portion 12. FIG. 2 also shows a first cam 30 and a second cam 28, with corresponding set screws 34 and 32. The cams 30 and 28 mount to the first bar 14 and second bar 16, respectively. The set screws 32 and 34 are used to secure the cams to the bars.

When a bar (14 or 16) is rotated, the corresponding cam (30 or 28) rotates and presses against the respective moveable portion 20 or 18) causing the tension in a string to increase.

It will be appreciated that cams 28 and 30 can be the same shape, but installed in opposite orientations in order to accommodate the opposite rotational directions of the bars, while maintaining the same upward movement against the moveable portions to cause the tension in a corresponding string to increase.

Figure 3:
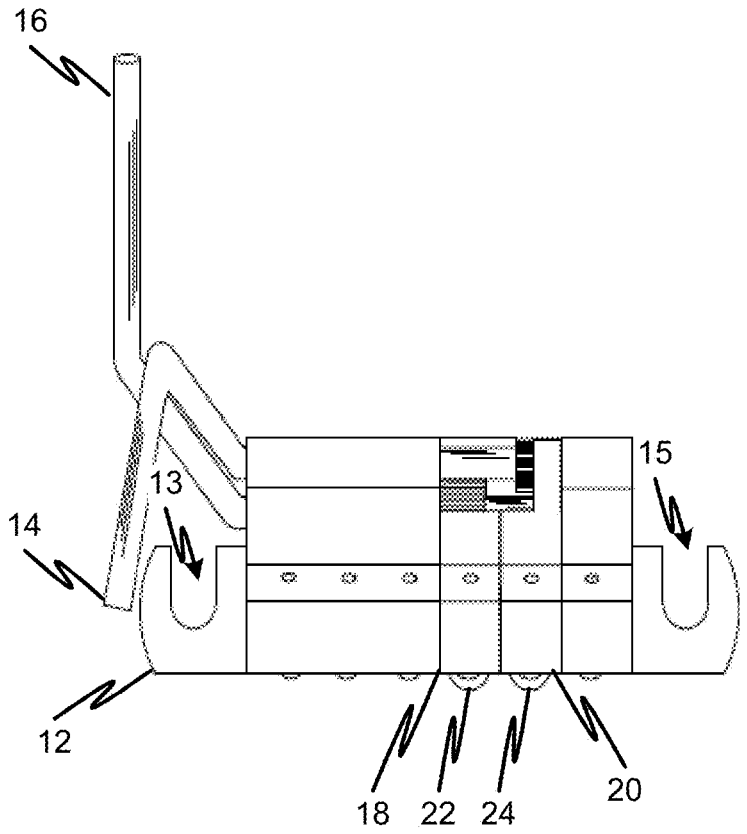
FIG. 3 is a top view of an exemplary string bender in accordance with at least one embodiment.

FIG. 3 is a top view of the string bender 10. In FIG. 3, the recesses (13 and 15) for mounting the string bender to the stop tailpiece mounting posts can be clearly seen.

Figure 4:
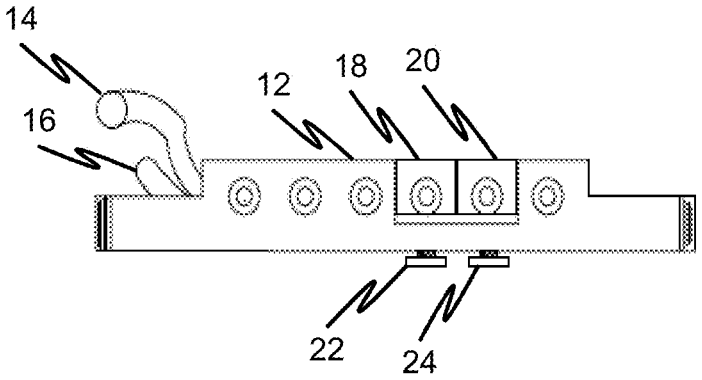
FIG. 4 is an end view, when viewed from the end of the guitar opposite the neck, of an exemplary string bender in accordance with at least one embodiment.
Figure 5:
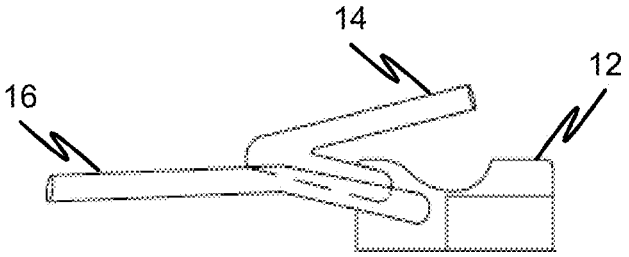
FIG. 5 is a top side view of an exemplary string bender in accordance with at least one embodiment.
Figure 6:
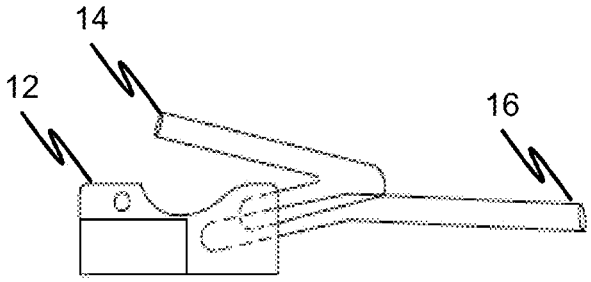
FIG. 6 is a bottom side view of an exemplary string bender in accordance with at least one embodiment.

FIG. 4 is an end view, when viewed from the end of the guitar opposite the neck, of the string bender 10. FIG. 5 is a top side view of an exemplary string bender 10. FIG. 6 is a bottom side view of an exemplary string bender 10.

Figure 7:
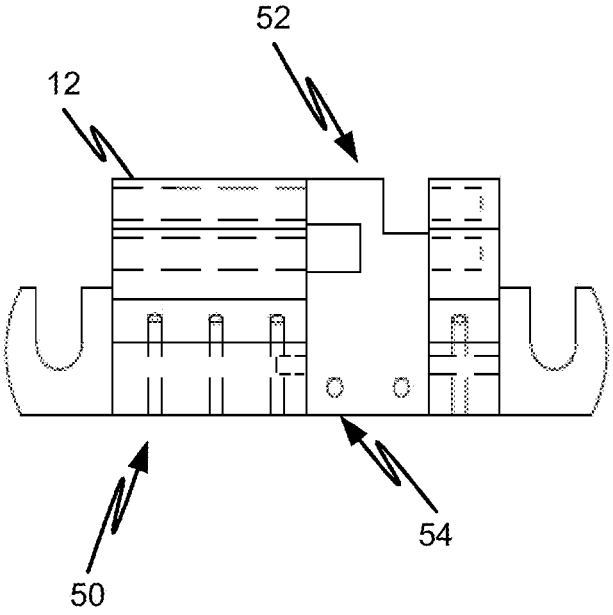
FIG. 7 is a top view of an exemplary base portion of a string bender in accordance with at least one embodiment.
Figure 8:
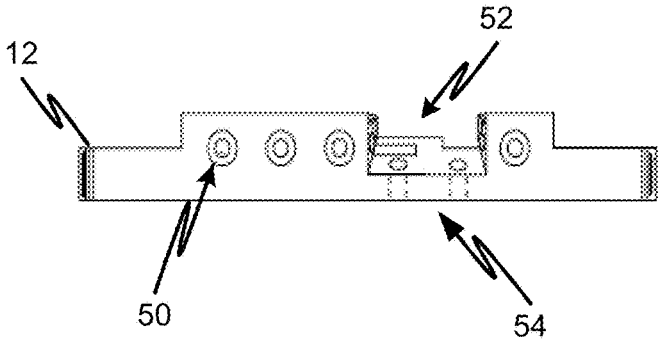
FIG. 8 is an end view, when viewed from the end of the guitar opposite the neck, when viewed from the end of the guitar opposite the neck, of an exemplary base portion of a string bender in accordance with at least one embodiment.

FIG. 7 is a top view of an exemplary base portion 12 of the string bender 10 of FIG. 1. FIG. 7 shows the holes 50 that permit strings to pass through the base portion 12, a recessed area 52 in which the moveable portion(s) are mounted and holes 54 in which adjustment screws for the moveable portions are mounted. FIG. 8 is an end view, when viewed from the end of the guitar opposite the neck, when viewed from the end of the guitar opposite the neck, of the base portion 12.

Figure 9:
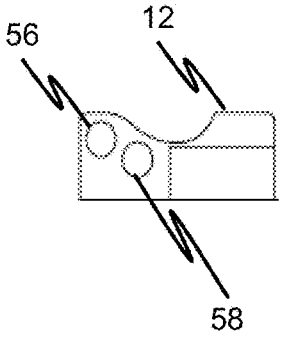
FIG. 9 is a top side view of an exemplary base portion of a string bender in accordance with at least one embodiment.
Figure 10:
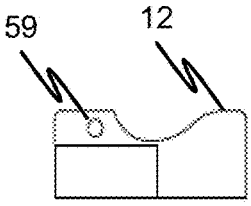
FIG. 10 is a bottom side view of an exemplary base portion of a string bender in accordance with at least one embodiment.

FIG. 9 is a top side view of the base portion 12 showing mounting holes 56 and 58 for the bars 14 and 16, respectively. FIG. 10 is a bottom side view of the base portion 12 showing a mounting hole 59 for the pin 26.

Figure 11:
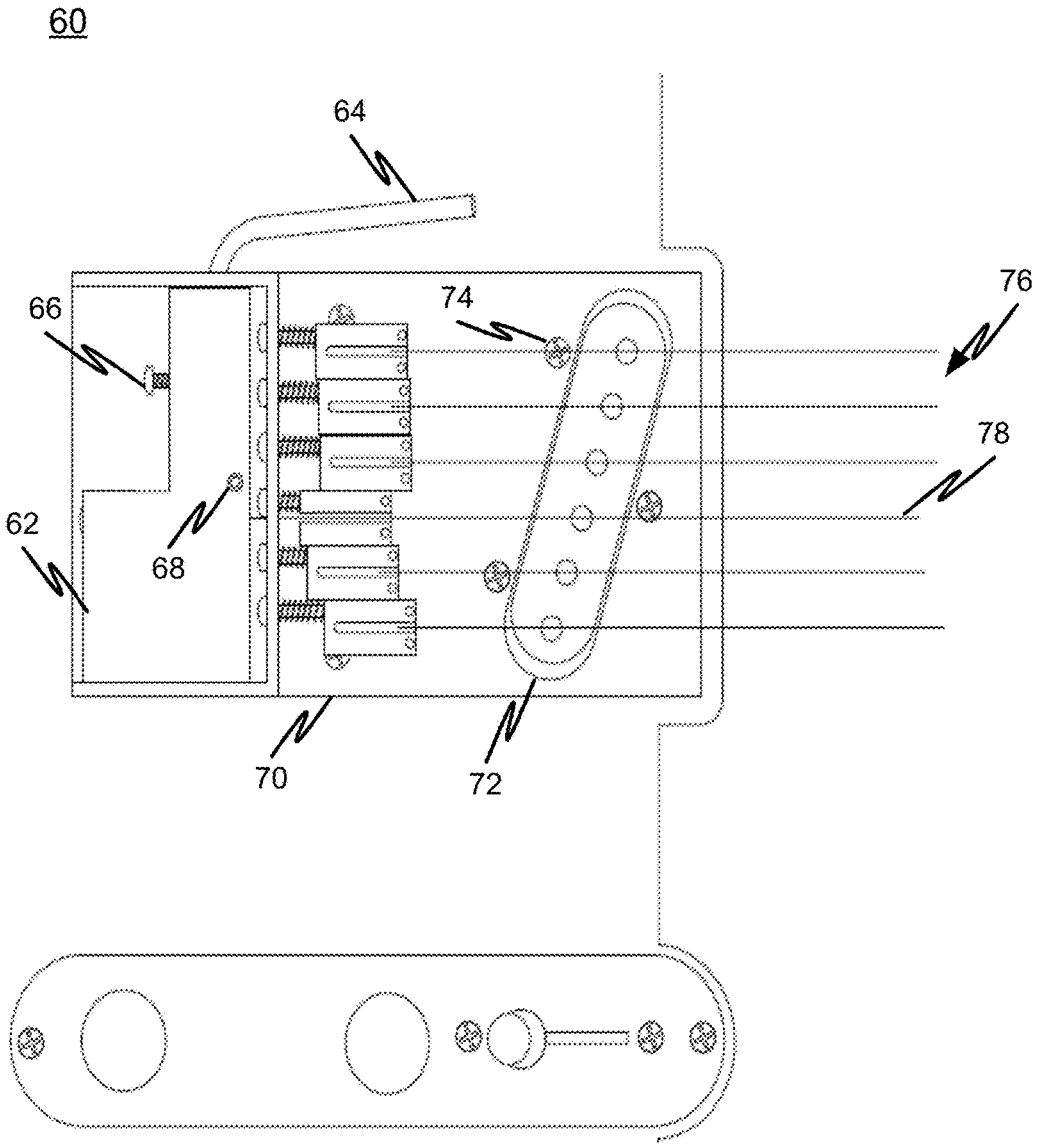
FIG. 11 is a perspective view of an exemplary string bender in accordance with at least one embodiment.

FIG. 11 is a perspective view of an exemplary string bender 60 having a moveable portion 62, a bar 64, a set screw 66, an adjustment screw 68, and a base portion 70.

The set screw 66 secures the moveable portion 62 to the bar 64. The adjustment screw 68 adjusts the position of the movable portion 62.

FIG. 11 also shows the location and mounting of the string bender 60 relative to a pickup 72 of the guitar. The guitar has a plurality of strings 76 and, as shown in FIG. 11, one string 78 extends though, and is anchored by, the moveable portion 62. This is the string that can be bent by the string bender 60.

Figure 12:
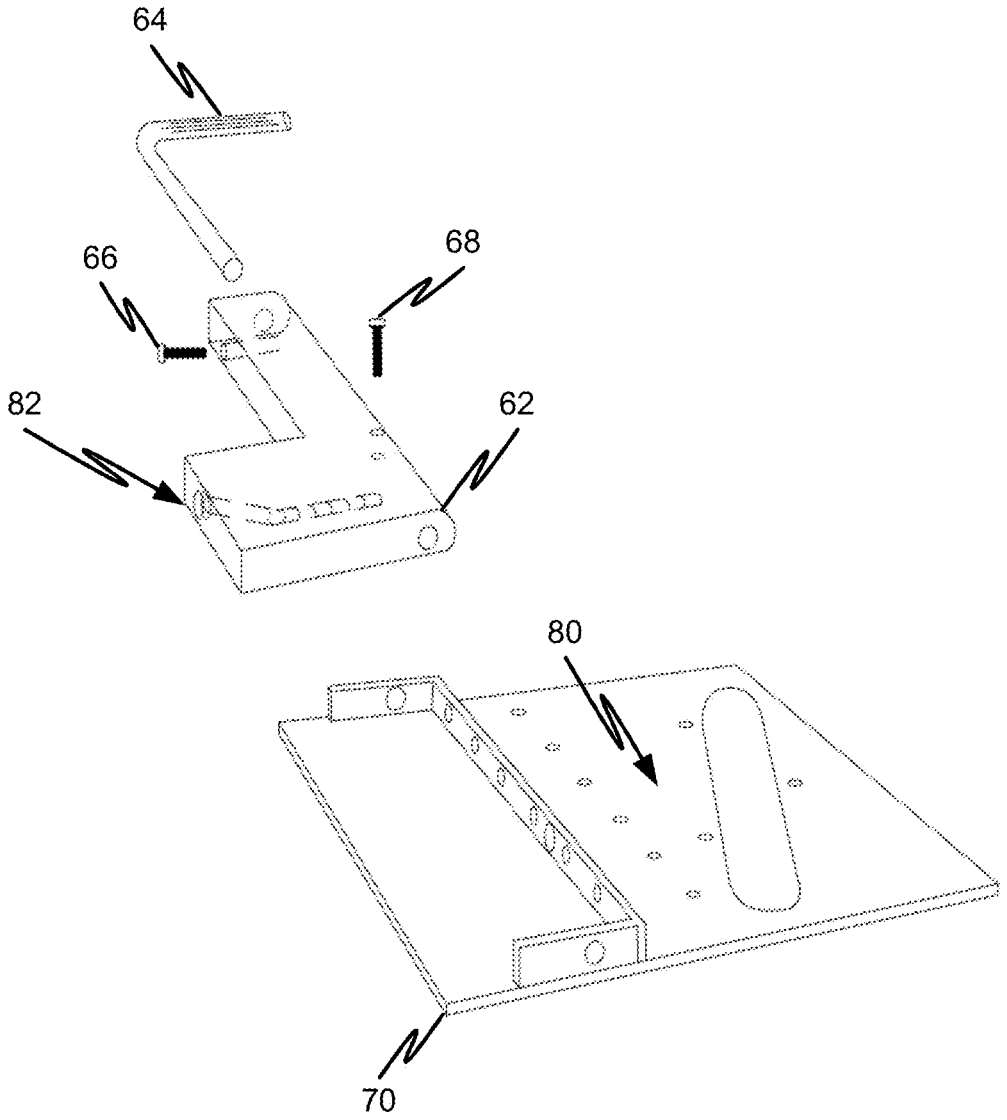
FIG. 12 is an exploded view of an exemplary string bender in accordance with at least one embodiment.

FIG. 12 is an exploded view of the string bender 60 showing a hole pattern 80 that can be configured to match an existing hole pattern in a particular guitar. Also, a channel 82 for the string being bent is shown through the moveable portion 62.

In operation, when pressure is applied to the bar 64 causing the bar 64 to rotate, the moveable portion 62 rotates and changes (e.g., increases) the tension on the string (e.g., 78) and changes the pitch of a note being played or to be played. When pressure on the bar 64 is released, the string tension returns to approximately what it was before the bar 64 was rotated and the pitch therefore returns to approximately the original tuned value.

It is, therefore, apparent that there is provided, in accordance with the various embodiments disclosed herein, string benders for stringed instruments.

While the invention has been described in conjunction with a number of embodiments, it is evident that many alternatives, modifications and variations would be or are apparent to those of ordinary skill in the applicable arts. Accordingly, Applicant intends to embrace all such alternatives, modifications, equivalents and variations that are within the spirit and scope of the invention.

What is claimed is:

1. A string bender comprising:

a base portion configured to anchor a plurality of strings and to removably mount to a guitar body;

at least one bar extending from the base portion in a direction substantially toward a top of the guitar body, the at least one bar being attached to a cam and disposed so as to be able to rotate relative to the base portion such that a rotation of the at least one bar causes a rotation of the cam and a change in tension of one of the strings, wherein the at least one bar includes a first bar and a second bar, the first bar being attached to a first cam associated with a first string and the second bar being attached to a second cam associated with a second string.

2. The string bender of claim 1, wherein the bar rotate about an axis substantially parallel with a front side of the guitar body.

3. The string bender of claim 1, wherein the plurality of strings are mounted from bottom to top of the guitar body and the first string is a string located second from the bottom.

4. The string bender of claim 1, wherein the plurality of strings are mounted from bottom to top of the guitar body and the second string is a string third from the bottom.

5. The string bender of claim 1, wherein the base portion replaces a stop tailpiece and mounts on posts used for mounting the stop tailpiece.

6. The string bender of claim 1, wherein the base portion replaces a bridge and includes mounting holes substantially aligned with mounting holes of the bridge.

7. A string bender comprising:

a base portion adapted to replace a stop tailpiece of a guitar and to anchor a plurality of strings, the base portion being releasably mounted to mounting elements on a body of the guitar for mounting the stop tailpiece to the guitar;

a first bar extending from the base portion in a direction substantially toward a top of the guitar body and neck of the guitar, a free end of the first bar being positioned toward a pickup, the first bar being attached to a first cam and being rotationally coupled to the base portion such that a rotation of the first bar causes a rotation of the first cam and a change in tension of a first string of the plurality of strings; and a second bar extending from the base portion in a direction substantially toward a top of the guitar body and neck of the guitar, a free end of the second bar being positioned toward an end pin of the guitar, the second bar being attached to a second cam and being rotationally coupled to the base portion such that a rotation of the second bar causes a rotation of the second cam and a change in tension of a second string of the plurality of strings.

8. The string bender of claim 7, wherein an axis of rotation of the first bar and the second bar is substantially parallel with a front side of the guitar body.

9. The string bender of claim 7, further comprising a first movable tailpiece member and a second movable tailpiece member, the first moveable tailpiece member adapted to anchor the first string and to be in contact with the first cam and the second moveable tailpiece member adapted to anchor the second string and to be in contact with the second cam.

10. The string bender of claim 7, having a plurality of mounting recesses each adapted to mate with a respective tailpiece mounting post.

11. The string bender of claim 7, wherein the first string is a string positioned second from a bottom of the guitar body.

12. The string bender of claim 7, wherein the second string is a string positioned third from a bottom of the guitar body.

13. The string bender of claim 9, further comprising a first set screw and a second set screw, the first set screw being disposed in the first moveable tailpiece member and the second set screw being disposed in the second moveable tailpiece member.

14. A string bender for a guitar comprising:

a base portion configured to anchor a plurality of strings and to be removably mounted to a guitar body, the base portion being adapted to replace a bridge on the guitar;

a bar extending from the base portion initially in a direction substantially toward a top of the guitar body and bending toward a direction of a neck of the guitar, the bar being attached to a movable portion and rotatable relative to the base portion such that a rotation of the bar causes a change in tension of one string of the plurality of strings.

15. The string bender of claim 14, wherein the bar rotates about an axis substantially parallel with a front side of the guitar body.

16. The string bender of claim 14, wherein the one string is positioned second from a bottom of the guitar body.

17. The string bender of claim 14, wherein the one string is positioned third from a bottom of the guitar body.

18. The string bender of claim 14, wherein the base portion includes a plurality of mounting holes substantially aligned with a plurality of mounting holes of the bridge.

19. The string bender of claim 14, further comprising a set screw disposed in the moveable portion and adapted to adjust an amount of rotation of the moveable portion.

* * * * *